United States Patent [19]

Dowdy et al.

[11] Patent Number: 4,984,790

[45] Date of Patent: Jan. 15, 1991

[54] BALL MARK REPAIR TOOL

[76] Inventors: John C. Dowdy, 419 Pleasant Hill Dr., Richmond, Va. 23236; Sheldon C. Drake, 3800 Pheasant Hollow Dr., Richmond, Va. 23231

[21] Appl. No.: 497,304

[22] Filed: Mar. 22, 1990

[51] Int. Cl.[5] ..... A63B 57/00

[52] U.S. Cl. ..... 273/32 B

[58] Field of Search ..... 273/32 A, 32 B; 294/120

[56] References Cited

U.S. PATENT DOCUMENTS

| | | | |
|---|---|---|---|
| 1,893,258 | 1/1933 | Washburn | 294/61 |
| 3,049,182 | 8/1962 | Pelow | 273/32 B |
| 3,539,017 | 11/1970 | Johnson | 273/32 B |
| 3,774,913 | 11/1973 | Dien | 273/32 A |
| 4,535,987 | 8/1985 | Dikoff | 273/32 A |
| 4,674,786 | 6/1987 | Lynch | 294/61 |
| 4,787,632 | 11/1988 | Nigrelli | 273/32 A |
| 4,862,970 | 9/1989 | Hlavacek | 273/32 R |
| 4,884,805 | 12/1989 | Patterson | 273/32 B |

*Primary Examiner*—Theatrice Brown

*Attorney, Agent, or Firm*—Staas & Halsey

[57] ABSTRACT

A ball mark repair includes a body having opposite sides and opposite ends, first and second spaced apart prongs extending outwardly from one end of the body substantially coplanar with one side of the body, and a third prong substantially centered between the first and second prongs and being substantially coplanar with the other side.

9 Claims, 1 Drawing Sheet

BALL MARK REPAIR TOOL

BACKGROUND OF THE INVENTION

The present invention relates generally to the game of golf and, more specifically, to a divot tool used to repair ball marks on greens.

FIELD OF THE INVENTION:

A "ball mark" is made when a golf ball lands on a green. The size of the mark depends on the velocity of the ball, the angle at impact, and the amount of moisture in the green. A very lofty shot can mean that the ball will impact at substantially 90° at close to terminal velocity (about 125 miles per hour). The mark left by such an impact is in fact a small depression corresponding to the shape of the ball.

The ball mark thus represents a discontinuity in the surface of the green which can make it unfairly difficult to putt on. Moreover, the grass of the green in the area of the depression or ball mark is substantially compacted with the ground beneath the grass. Grass commonly used for greens requires aeration of the root system, so that if the ball mark is not repaired, the grass within the depression will likely die and leave a brown spot in the green.

Most country clubs require, and constantly remind, golfers to repair their ball marks. Typically, a golfer uses a golf tee which is pushed into the green at an angle around the periphery of the ball mark, so that the point of the tee penetrates into the area of compacted ground and grass in the depression area. After pushing the tee into the ground as aforementioned, the tee is then used as a lever to pry the ground in the depression upwardly so as to remove the ball mark by returning the green to its former, smooth surface.

While the golf tee-technique is usually effective, it requires several insertions of the tee, and subsequent prying movements, around the periphery of the ball mark to effectively "uproot" the mark. In the end, the golfer lightly taps on the area of the ball mark to finish the area with a smooth surface after the depression has been uprooted. This also tends to remove a rim which can sometimes be formed around the ball mark as a result of lateral displacement of grass and ground, as opposed to axial compaction.

Repair tools have been used in the past as an alternative to the golf tee-technique. These tools are exemplified in FIGS. 1 and 2, which represent two different forms, each of which has a spade-like digging portion.

Referring to FIG. 1, a repair tool 10 has an upper portion 12 and a two-prong spade portion 14. The upper portion 12 includes an eyelet 16 through which a key chain can pass so as to allow the golfer to carry the tool 10 as part of his or her keys. The two prongs 18 and 20 are substantially coplanar so as to provide the tool 10 with an overall thin profile such as 1/16 to ⅛ inch thickness.

A three-prong version of a repair tool is illustrated in FIG. 2. In both the repair tools of FIGS. 1 and 2, the major design concern was for comfort when placed in the pocket of the golfer. Also, the flat shape of the tool made it easy to manufacture.

While comfort and ease of manufacture are important concerns, they do not override the most important concern which is to properly repair the ball mark. Generally speaking, the tools such as those illustrated in FIGS. 1 and 2 do not perform satisfactorily. One of the most serious problems with the aforementioned tools is that because the prongs lie in the same plane, it is nearly impossible to evenly lift the ground in the depression of the ball mark. In the history of golf, ball mark tools have been substantially planar, meaning that the prongs are aligned in a single row or "plane". Multiple rows or planes have not heretofore been contemplated in repair tool design.

SUMMARY OF THE INVENTION

An object of the present invention is to provide a ball mark repair tool which is easy to grip and effective to evenly lift the depression of a ball mark.

Another object of the present invention is to provide a ball mark repair tool which is capable of repairing a ball mark using a minimum number of insertions into the ground.

Another object of the present invention is to provide a ball mark repair tool which can be easily manufactured by injection molding.

These and other objects of the invention are met by providing a ball mark repair tool which includes a body and prong means disposed in multiple planes and extending outwardly from the body. Preferably, the body has opposite sides and opposite ends, and the prong means includes first and second spaced apart prongs extending outwardly from one end of the body substantially coplanar with one side of the body and a third prong substantially centered between the first and second prongs and being substantially coplanar with the other side.

In a preferred embodiment, the third prong is longer than the first two, and is inserted into the ground before the first and second prongs. Also, the body preferably has a thumb depression on the side with the first and second prongs, while the opposite side has an undulating surface for receiving the fingers of the golfer using the tool. The thumb depression and undulating surface provides a good grip for effecting ball mark repairs.

These and other features and advantages of the ball mark repair tool of the present invention will become more apparent with reference to the following detailed description and drawings.

DETAILED DESCRIPTION OF THE PREFERRED EMBODIMENT

Figure 1:
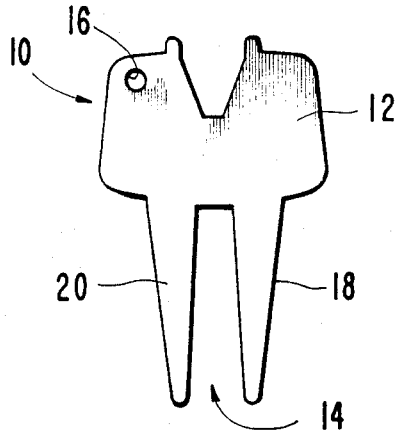
FIG. 1 (PRIOR ART)
FIG. 1 is a plan view of a known ball mark repair tool.

Referring to FIGS. 3–7, a ball mark repair tool according to the present invention is generally referred to by the numeral 22. The tool 22 includes a body 24 having opposite ends 26 and 28, and opposite sides 30 and 32. The opposite sides 30 and 32 are used to grip the tool. Overall, the body 24 is substantially rectangular, so as to further include opposite sides 34 and 36.

First and second spaced apart prongs 38 and 40 extend outwardly from the end 26 of the body 24 substantially coplanar with the side 30 of the body. A third prong 42 is substantially centered between the first and second prongs 38 and 40 and is substantially coplanar with the opposite side 32. Thus, the prongs 38 and 40 lie in a different plane than the prong 42. The word "plane" is readily understood here to refer to the prongs being in different rows. Thus, the longitudinal axes of prongs 38 and 40 lie in one "plane", while the longitudinal axis of prong 42 lies in a second plane.

Preferably, the prong 42 is longer than the prongs 38 and 40. This is so that when the prong 42 is inserted into the ground, it can penetrate through to the deepest part of the depression of the ball mark, while the upper prongs 38 and 40 can lift part of the depression which lies above the bottom.

A thumb depression 44 is provided in the upper surface or side 30 of the body 24, while undulations 46 are formed in the opposite, lower side 32. The undulations 32 and thumb depression 44 facilitate gripping of the body so as to manipulate the tool to affect a ball mark repair. It is significant that the body 24 has a height dimension created by the length of the sides 34 and 36. This thicker body makes the tool easier to handle and provides the golfer with more leverage for prying the ground upwardly after insertion of the prongs into the ground around the ball mark.

While the prongs have been described as being coplanar with the opposite sides of the body, it should be noted that the prongs themselves have a width dimension which allows them to be strong enough to pry the ground upwardly. It is most significant that the upper prongs 38 and 40 are shorter than the lower prong 42 and, critically, the lower prong 42 has to lie in a different plane than the two upper prongs.

Figure 2:
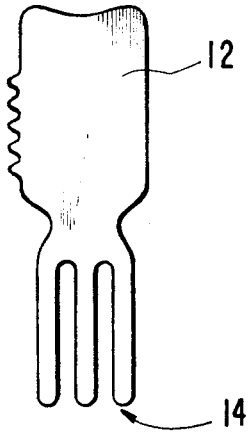
FIG. 2 (PRIOR ART)
FIG. 2 is a plan view of another known ball mark repair tool.
Figure 3:
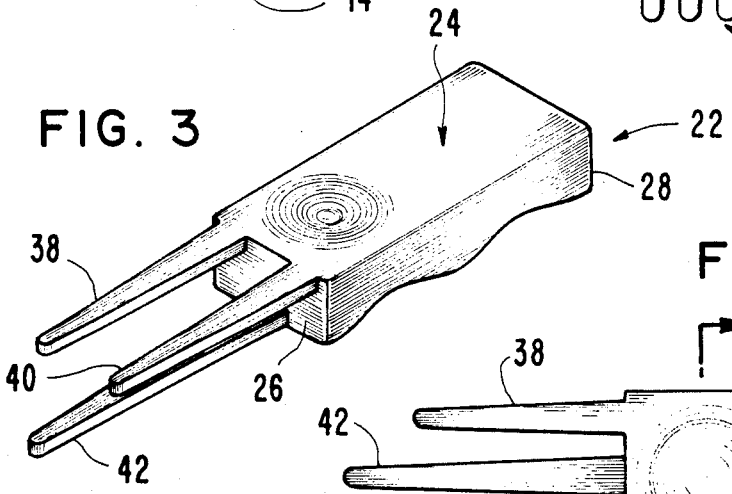
FIG. 3 is a perspective view of a ball mark repair tool according to the present invention.
Figure 4:
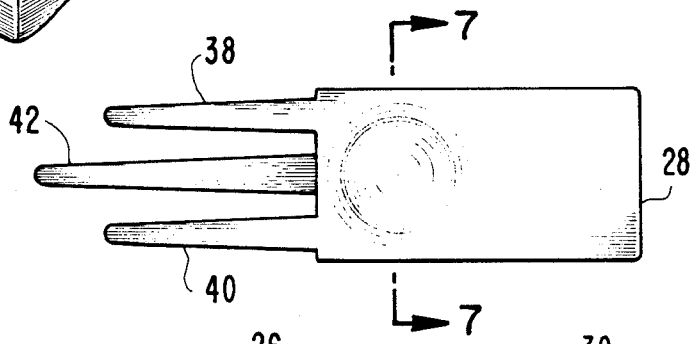
FIG. 4 is a top plan view of the repair tool of FIG. 3.
Figure 5:
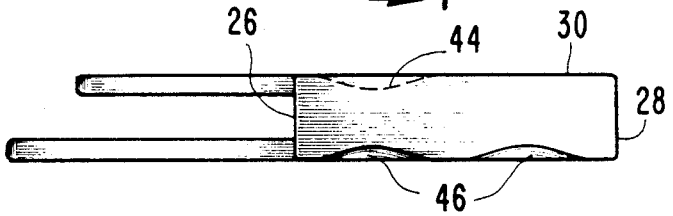
FIG. 5 is a side elevational view of the repair tool of FIG. 3.
Figure 6:
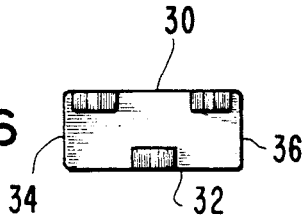
FIG. 6 is an end view of the repair tool of FIG. 3.
Figure 7:
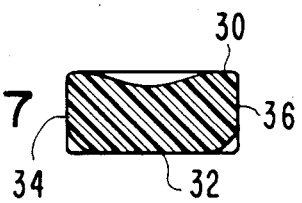
FIG. 7 is a sectional view taken along line 7—7 of FIG. 4.

The previously used tools illustrated in FIGS. 1 and 2 have their prongs lying in the same plane, and the prongs are too close together to be effective. Because a golf ball will make a spherically shaped depression, the bottom of the depression will require more lifting than the sides. This is accomplished according to the present invention by providing a longer prong in a separate plane than two upper prongs. The long prong 42 addresses the deepest portion of the depression, which also occurs at the center point of the depression. Thus, it is preferable to place the longest prong 42 centered between the two shorter prongs 38 and 40. Also, the two upper prongs are preferably about 0.75 inches apart. This has been found to result in a more uniform lifting of the upper portion of the depression.

By using a sculpted body having thumb depressions and undulations for receiving the fingers of the golfer, it is easy to hold the tool between the index finger and the thumb. When the tool is pushed into the ground, the longest, lower prong 42 passes under the deepest part of the depression, so that when the tool is then pried by tilting it away from the center of the depression, the bottom of the depression is lifted by the lower prong, while the upper prongs lift an area of the depression above the lowest point.

Preferably, the longest prong 42 lies in a plane about ⅜ inch away from the plane which encompasses the upper prongs.

As alternative embodiments, the three prongs may be retractably received in the body so that, prior to use, the entire tool resembles just the body portion shown in the drawings. Details of the structure which facilitates retractable mounting need not be described herein since one of ordinary skill in the art would have any number of ways to retractably mount the prongs. However, in the preferred embodiment, the prongs are integrally molded with the body from plastic material. In this case, it is possible to provide a cover for the prongs in the form of a cap which snap fits over the prongs and connects to the body.

Another feature of the present invention is that the body can be formed with a depression 28*a* (FIG. 5) for receiving a ball marker, such as a coin 28*b* or other suitable disk, which can be removed from the body of the tool to mark the position of a player's ball on the green.

Numerous modifications and adaptations of the present invention will be apparent to those so skilled in the art and thus, it is intended by the following claims to cover all such modifications and adaptations which fall within the true spirit and scope of the invention.

What is claimed is:

1. A ball mark repair tool of a size capable of being carried in a golfer's pocket comprising:

a body adapted to be held in and manipulated by the hand; and at least two prongs disposed in substantially the same first plane and at least one prong disposed in a second plane spaced from said first plane and said prongs extending outwardly from the body and adapted to be inserted in the ground under a ball mark and used to lift the depression of said ball mark.

2. A ball mark repair tool according to claim 1, wherein:

the body has opposite sides and opposite ends, and said prongs includes first and second spaced apart prongs extending outwardly from one end of the body substantially coplanar with one side of the body; and a third prong substantially centered between the first and second prongs and being substantially coplanar with the other side.

3. A ball mark repair tool according to claim 2, wherein the first and second prongs are shorter than the third prong.

4. A ball mark repair tool according to claim 2, wherein the body and first, second and third prongs are integrally molded of plastic material.

5. A ball mark repair tool according to claim 2, wherein the third prong is centered with respect to the body, and the first and second prongs are symmetrically disposed around the third prong.

6. A ball mark repair tool according to claim 2, wherein the body has a thumb depression in the side which is coplanar with the first and second prongs for gripping the tool.

7. A ball mark repair tool according to claim 6, wherein the side of the body which is substantially coplanar with the third prong includes undulations for further enhancing the grip of the body by conforming to a user's fingers.

8. A ball mark repair tool according to claim 2, wherein the first and second prongs are ¾ inch apart, and wherein the first and second prongs are about ⅜ inch from the third prong.

9. A ball mark repair tool according to claim 2, further comprising a ball marker removably mounted on the body.

* * * * *